US007526934B2

(12) United States Patent
Conforti

(10) Patent No.: US 7,526,934 B2
(45) Date of Patent: May 5, 2009

(54) DOOR WIRELESS ACCESS CONTROL SYSTEM INCLUDING READER, LOCK, AND WIRELESS ACCESS CONTROL ELECTRONICS INCLUDING WIRELESS TRANSCEIVER

(75) Inventor: Fred Conforti, Lisle, IL (US)

(73) Assignee: Harrow Products LLC, Montvale, NJ (US)

( * ) Notice: Subject to any disclaimer, the term of this patent is extended or adjusted under 35 U.S.C. 154(b) by 0 days.

(21) Appl. No.: 10/887,619

(22) Filed: Jul. 9, 2004

(65) Prior Publication Data

US 2004/0261478 A1 Dec. 30, 2004

Related U.S. Application Data

(63) Continuation of application No. 10/193,513, filed on Jul. 11, 2002, now abandoned.

(60) Provisional application No. 60/326,179, filed on Sep. 30, 2001.

(51) Int. Cl.
*E05B 47/00* (2006.01)

(52) U.S. Cl. ..... 70/279.1; 70/417; 340/5.7

(58) Field of Classification Search ..... 70/277, 70/278.7, 279.1, 280–283, 417, 256, 278.1, 70/278.2, 278, 7; 340/5.2, 5.64, 5.7, 5.71, 340/5.72, 5.73

See application file for complete search history.

(56) References Cited

U.S. PATENT DOCUMENTS

| | | | | |
|---|---|---|---|---|
| 306,806 | A | 10/1884 | Barnes | |
| 528,589 | A | 11/1894 | Brownell et al. | |
| 1,946,384 | A | 2/1934 | Baril et al. | |
| 3,967,478 | A * | 7/1976 | Guinn | 70/144 |
| 4,048,630 | A | 9/1977 | Deming et al. | |
| 4,397,168 | A * | 8/1983 | Rotondi et al. | 70/417 |
| 4,539,555 | A | 9/1985 | Tefka | |
| 4,557,121 | A | 12/1985 | Charlton | |
| 4,579,376 | A | 4/1986 | Charlton | |
| 4,634,155 | A | 1/1987 | Geringer et al. | |
| 4,677,834 | A | 7/1987 | Hicks | |
| D306,806 | S | 3/1990 | Hill | |
| 4,967,478 | A | 11/1990 | Sherman | |
| 5,009,456 | A | 4/1991 | Eck | |
| 5,095,654 | A * | 3/1992 | Eccleston | 292/144 |
| 5,148,691 | A | 9/1992 | Wallden | |
| 5,263,347 | A | 11/1993 | Allbaugh et al. | |
| 5,308,131 | A | 5/1994 | Galindo et al. | |

(Continued)

FOREIGN PATENT DOCUMENTS

| | | |
|---|---|---|
| FR | 2749607 | 12/1997 |

(Continued)

*Primary Examiner*—Patricia L Engle
*Assistant Examiner*—Christopher Boswell
(74) *Attorney, Agent, or Firm*—Michael Best & Friedrich LLP

(57) ABSTRACT

The preferred embodiments of the present invention provide an improved access control system that provides additional security for the connection between an existing locking system and an access control system, for example, to prevent tampering. The security system preferably includes a control line shield to protect a control line running from an access reader to an external lock incorporated in a door, for example. The control line shield seals the control line into the interior of the door to prevent easy access for interference and tampering Additionally, the control line shield may be removed as necessary to provide service to the access system.

19 Claims, 4 Drawing Sheets

U.S. PATENT DOCUMENTS

| | | | | |
|---|---|---|---|---|
| 5,313,812 | A | 5/1994 | Eklund et al. | |
| 5,410,444 | A | 4/1995 | Juds | |
| 5,475,375 | A | 12/1995 | Barrett et al. | |
| 5,479,151 | A | 12/1995 | Lavelle et al. | |
| 5,531,086 | A | 7/1996 | Bryant | |
| 5,602,536 | A | 2/1997 | Henderson et al. | |
| 5,608,298 | A | 3/1997 | Frolov | |
| 5,611,582 | A | 3/1997 | Frolov et al. | |
| 5,630,169 | A | 5/1997 | Jackson | |
| 5,682,135 | A | 10/1997 | Labonde et al. | |
| 5,683,127 | A | 11/1997 | Chamberlain | |
| 5,705,991 | A | 1/1998 | Kniffin et al. | |
| 5,722,276 | A | 3/1998 | Aigner et al. | |
| 5,729,198 | A | 3/1998 | Gorman | |
| 5,769,472 | A | 6/1998 | Small | |
| 5,791,178 | A | 8/1998 | Chamberlain et al. | |
| D397,993 | S | 9/1998 | Jimenez | |
| 5,808,296 | A | 9/1998 | McMonagle et al. | |
| 5,881,055 | A | 3/1999 | Kondo | |
| 5,933,086 | A | 8/1999 | Tischendorf et al. | |
| 5,936,544 | A | 8/1999 | Gonzales et al. | |
| 5,940,771 | A | 8/1999 | Gollnick et al. | |
| 6,021,477 | A | 2/2000 | Mann | |
| 6,035,676 | A | 3/2000 | Hudspeth | |
| 6,038,896 | A | 3/2000 | Chamberlain et al. | |
| 6,067,297 | A | 5/2000 | Beach | |
| 6,076,385 | A | 6/2000 | Pedroso et al. | |
| 6,108,108 | A | 8/2000 | Peng | |
| 6,108,188 | A | 8/2000 | Denison et al. | |
| 6,167,934 | B1 | 1/2001 | Debroche | |
| 6,189,351 | B1 | 2/2001 | Eagan et al. | |
| 6,212,175 | B1 | 4/2001 | Harsch | |
| 6,259,352 | B1 * | 7/2001 | Yulkowski et al. | 70/277 |
| 6,285,295 | B1 | 9/2001 | Casden | |
| 6,297,725 | B1 | 10/2001 | Tischendorf et al. | |
| 6,330,817 | B1 | 12/2001 | Frolov | |
| 6,347,486 | B1 * | 2/2002 | Badillet | 70/278.1 |
| 6,397,061 | B1 | 5/2002 | Jordan et al. | |
| RE37,784 | E * | 7/2002 | Fitzgibbon et al. | 318/466 |
| 6,434,985 | B1 * | 8/2002 | Walmsley | 70/277 |
| 6,486,793 | B1 * | 11/2002 | Buccola | 70/279.1 |
| 6,665,520 | B2 | 12/2003 | Romans | |
| 6,679,019 | B2 * | 1/2004 | Rochman | 70/417 |
| 6,714,118 | B1 * | 3/2004 | Frolov et al. | 70/279.1 |
| 6,828,902 | B2 | 12/2004 | Casden | |
| 6,879,259 | B1 | 4/2005 | Smith et al. | |
| 6,958,976 | B2 | 10/2005 | Kikkawa et al. | |
| 2002/0177473 | A1 | 11/2002 | Skinner et al. | |
| 2002/0180582 | A1 | 12/2002 | Nielsen | |
| 2003/0025082 | A1 | 2/2003 | Brewington et al. | |

FOREIGN PATENT DOCUMENTS

| | | |
|---|---|---|
| WO | WO 02/25040 | 3/2002 |

* cited by examiner

DOOR WIRELESS ACCESS CONTROL SYSTEM INCLUDING READER, LOCK, AND WIRELESS ACCESS CONTROL ELECTRONICS INCLUDING WIRELESS TRANSCEIVER

RELATED APPLICATIONS

The present application is a continuation of U.S. patent. application Ser. No. 10/193,513 filed Jul. 11, 2002, now abandoned entitled "Improved Door Wireless Access Control System Including Reader, Lock, and Wireless Access Control Electronics Including Wireless Transceiver" which claims the benefit of U.S. Provisional Patent Application No. 60/326,179 filed Sep. 30, 2001entitled "General Access Control For Locking System."

BACKGROUND OF THE INVENTION

The present invention generally relates to an RF access control system. More particularly, the present invention relates to general access control for an RF access control system including an improved system of integrating an access reader, a locking mechanism, and access control electronics including a transceiver.

The applicants have filed several provisional patent applications setting forth various elements of a newly developed system for a wireless access control system. These applications include: U.S. Provisional Patent Application No. 60/326,179 filed Sep. 30, 2001 entitled "General Access Control For Locking System" and U.S. Provisional Patent Application No. 60/326,299 filed Sep. 30, 2001 entitled "Energy Saving Motor-Driven Locking Subsystem" both of which are hereby incorporated by reference in their entirety.

As set forth in the above-referenced applications, a wireless access control system may be installed at a door, for example, to provide access. The wireless access control system may include an access reader for receiving access information at the door and access control electronics including a transceiver for wirelessly relaying the access information to a remote entity to determine whether or not access is granted. The decision to grant or deny access may then be sent from the remote entity to the access control electronics via its transceiver. When the access control electronics receives a signal back through its transceiver, it may then send a signal to open the door's lock.

One embodiment set forth in the above applications shows the integration of an electric lock with an access reader control and wireless access control electronics including a transceiver to make a wireless access control system at the door. Integrating the elements of the access control system at the door and making it wireless may be preferable to wiring individual components around the door and then wiring back to a panel. However, the integration of the electric lock with the rest of the wireless access control system at the door may create security concerns. For example, the connection between the electric lock and the access control electronics may be vulnerable to interference or attack.

Thus, a need exists for a system and method for providing additional security for the connection between the electric lock and the access control electronics, for example, to prevent tampering. A need especially exists for the protection of command or control signals traveling from the access control electronics to the electric lock.

SUMMARY OF THE INVENTION

The present invention provides an improved access control system with a control line shield for use in a wireless access control system. The control line shield may protect a control line running from the access control electronics to the electric lock incorporated in a door, for example. The control line shield seals the control line into the interior of the door to prevent easy access. Thus, the control line shield helps to keep the control line from the access control electronics to the electric lock safe from outside interference and tampering. Additionally, the control line shield may be removed as necessary to provide service to the access system.

These and other features of the present invention are discussed or apparent in the following detailed description of the preferred embodiments of the invention.

DETAILED DESCRIPTION OF THE PREFERRED EMBODIMENTS

Figure 1:
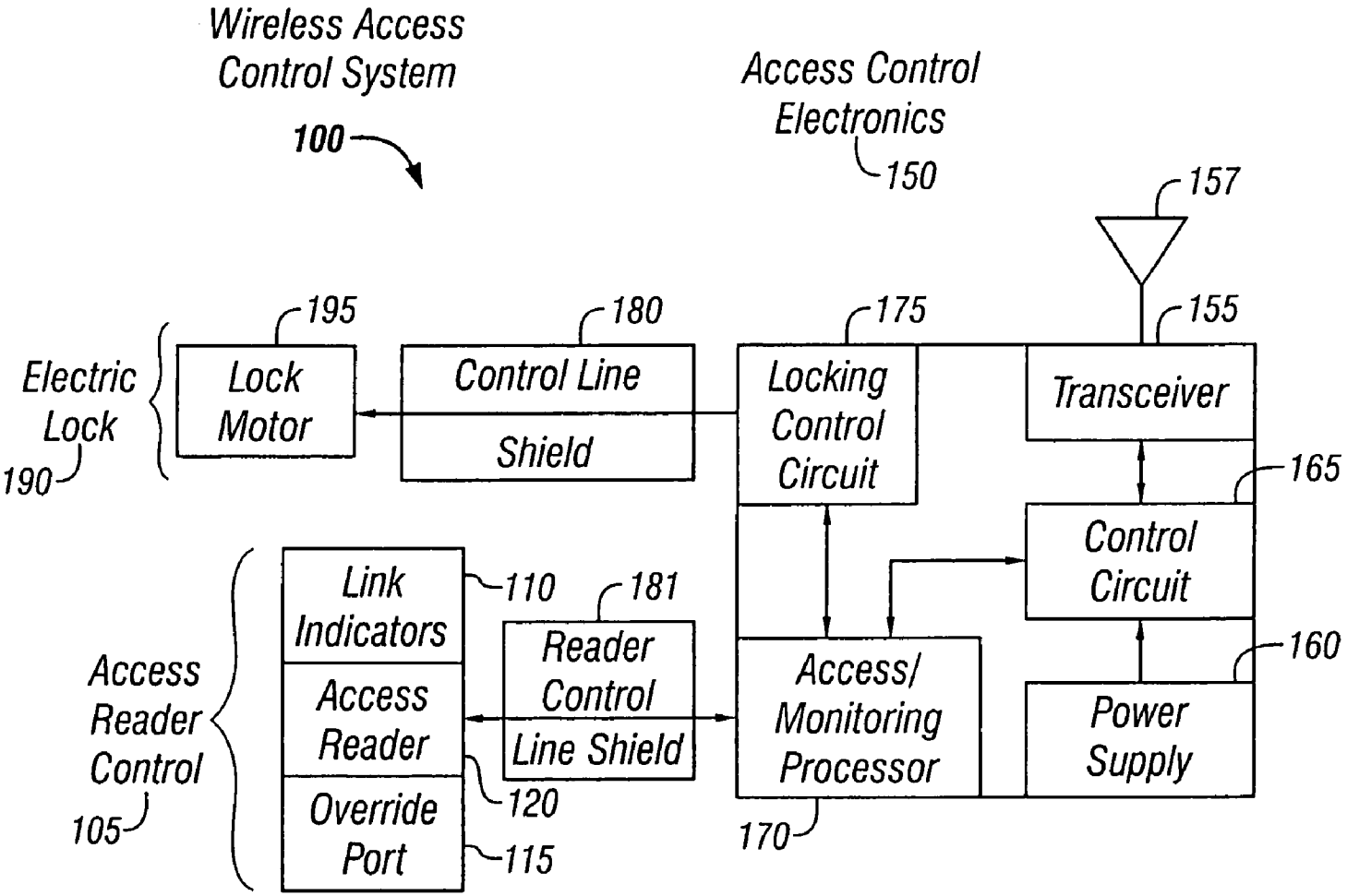
FIG. 1 illustrates an improved access control system with control line shield for a wireless access control system according to a preferred embodiment of the present invention.

FIG. 1 illustrates an improved wireless access control system 100 with control line shield 180 for a wireless access control system according to a preferred embodiment of the present invention. The wireless access control system 100 includes an access reader control 105, access control electronics 150, a control line shield 180, a reader control line shield 181 and an electric lock 190.

The access reader control 105 includes one or more link indicators 110, an override port 115, and an access reader 120. The access control electronics 150 includes a transceiver 155, an antenna 157, a power supply 160, which may be external, a control circuit 165, an access/monitoring processor 170, and a locking control circuit 175. The lock 190 includes a lock motor 195.

The power supply 160 provides power to the access control system 100 including powering the transceiver 155, the control circuit 165, the locking control circuit 175, the electric motor 195, the access reader control 105, and the access/monitoring processor 170. The power supply 160 may be an internal battery or other internal type of power supply. Alternatively, an external AC power supply may be employed. The transceiver 155 is coupled to the antenna 157 to allow RF signals to be sent and received from the wireless access control system 100 to an external point. The control circuit 165 sends and receives data from the access/monitoring processor 170 and the transceiver 155. Additionally, the control circuit 165 regulates the power supplied to the access reader control 105 by the power supply 160.

The access/monitoring processor 170 sends signals to and receives signals from the control circuit 165 and the access reader 120 and sends signals to and receives signals from the locking control circuit 175. The access/monitoring processor 170 receives power from the control circuit 165. The access/monitoring processor 170 in turn powers the link indicators 110, locking control circuit 175, override port 115, and access reader 120. The access/monitoring processor 170 additionally controls the link indicators 110 and receives data from the access reader 120 as well as the override ports 115. The access/monitoring processor 170 also sends commands to the locking control circuit 175 and receives data from the locking control circuit 175.

The link indicators 110 may be a graphical or audible signal that the wireless access control system 100 has read an access signal, transmitted the access signal to the remote access control panel, received a confirmation, or activated the locking member, for example. The override port 115 may be used, for example, by a technician to provide service or power to the wireless access control system. The access reader 120 may read access information to aid in determining whether access should be granted. The access information may be of any type, but is preferably a biometric, proximity, magstripe or similar identifier. The lock motor 195 may be of any type and may control a locking bar or other security device, for example.

The locking control circuit 175 is coupled to and provides control for the lock motor 195. The coupling between the locking control circuit 175 and the lock motor 195 is protected by a control line shield 180 which serves to reduce access to the control line between the locking control circuit 175 and the lock motor 195. The control line shield 180 may, for example, be a physical shield that limits access to the control line, such as a metal plate or a pre-formed housing within a door.

In operation, an access signal may be received from the access reader 120. The access signal is then relayed to the access/monitoring processor 170. The access/monitoring processor 170 then sends the access signal to control circuit 165 which passes the signal to the transceiver 155. The transceiver 155 transmits the access signal to a database of authorized access signals (e.g., an access control panel). If the correct access data is in the database, a confirmation is transmitted to the transceiver 155. The confirmation is relayed from the transceiver 155 to the access/monitoring processor 170 through the control circuit 165. The access/monitoring processor 170 then sends a control signal to the locking control circuit 175. When the locking control circuit 175 receives the control signal, the locking control circuit 175 activates the lock motor 195 to allow access. The connecting line between the locking control circuit 175 to the lock motor 195 is protected by the control line shield 180.

As shown in FIG. 1, the power supply 160 is not contained within the access reader control 105, and the access reader control 105 receives power from the power supply 160 via a link that provides power and communications between the access reader control 105 and the access control electronics 150. Alternatively, the power supply 160 may be included as part of the access reader control 105. Additionally, any or all of the functionality of the access control electronics 150 may be integrated with the access reader control 105.

Additionally, in FIG. 1, the wiring is shown as running between the access reader control 105 and the access control electronics 150 separately from the wiring running between the external lock 190 and the access control electronics 150. The wiring between the access reader control 105 and the access control electronics 150 is protected by a reader line shield 181. The reader line shield 181 serves to limit access to the wiring to reduce undesired tampering with the system. In one case the reader line shield may be the door itself as the wiring between the access reader control 105 and the access control electronics passes through the door. Alternatively, the wiring may run from the access control electronics 150 to the access reader control 105 to the external lock. In this instance, the control line shield 180 is configured to protect the wiring from the access reader control 105 to the external lock 195. As an additional alternative, both the access reader control 105 and the access control electronics 150 may be wired to the external lock 190. In this instance, the control line shield 180 protects both sets of wiring.

Further discussion of various elements of the wireless access control system 100 are discussed in U.S. Provisional Patent Application No. 60/326,179 filed Sep. 30, 2001 entitled "General Access Control For Locking System" and U.S. Provisional Patent Application No. 60/326,299 filed Sep. 30, 2001 entitled "Energy Saving Motor-Driven Locking Subsystem" which are hereby incorporated by reference in their entirety.

Figure 2:
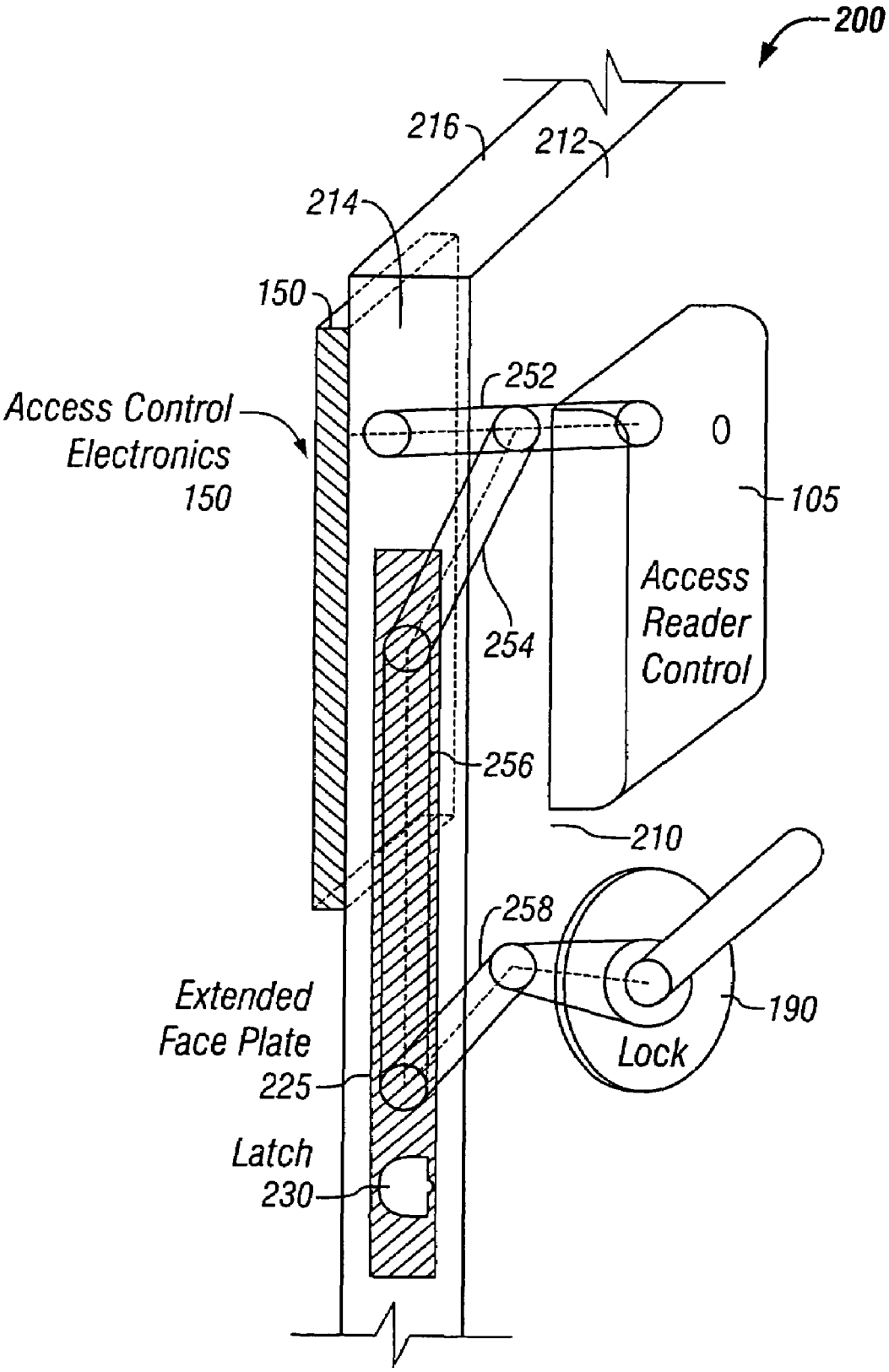
FIG. 2 illustrates a perspective view of the installation of the wireless access control system according to a preferred embodiment of the present invention.

FIG. 2 illustrates an installation 200 of the wireless access control system 100 according to a preferred embodiment of the present invention. The installation 200 includes a door 210, an access reader control 105, access control electronics 150, an external lock 190 and a control line shield embodied as an extended face plate 225. Additionally, the door itself acts as a reader line shield between the access control reader 105 and the access control electronics 150. The external lock 190 includes a lock motor (not shown) that controls a latch 230 to lock or unlock the door 210. The door 210 includes a door front face 212 and a door edge 214 and a door back face 216.

Additionally, several channels have been formed in the door 210 to allow the passage of wiring a through-door channel 252, and out-to-edge channel 254, an along-edge channel 256, and an in-to-lock channel 258. The through-door channel 252 serves to provide a passage for wiring connecting the access reader control 105 and the access control electronics 150. Thus, as shown in FIG. 2, the access reader control 105 and the access control electronics 150 are connected by wiring running through the body of the door 210 perpendicular to the plane of the face of he door 210. The wiring connecting the access reader control 105 and the access control electronics 150 is thus typically safe from outside interference and tampering because is it concealed within the core of the door 210.

Also, as shown in FIG. 2, the access reader control 105 and/or access control electronics 150 may be connected by wiring to the external lock 190. That is, the through-door channel 252 intersects with the out-to-edge channel 254 to allow the passage of wiring out to the door edge 214. At the door edge 214, the wiring passes from the out-to-edge channel 254 to the along-edge channel 256 which is preferably inset into the face of the door edge 214. The wiring then passes from the along-edge channel 256 to the in-to-lock channel 258 and then to the electric lock 190.

Thus, starting at the access reader control 105, the wiring preferably runs substantially perpendicular to the door face 212 through channel 252 then parallel to the door face 212 and to the door edge 214. The wiring then preferably runs along the door edge 214 downward to the height of the lock and then preferably runs from the door edge 214 inward substantially parallel to the door face 212 to the external lock 190.

In FIG. 2, the wiring that runs along the door edge 214 is protected by a control line shield, in this case and extended face plate 225. The extended face plate 225 differs from the standard face plate because the extended face plate 225 has been increased in the vertical dimension, as compared to a standard faceplate, to protect the wiring running along the door edge 214. Typically, in installing the extended face plate 225, the edge of the door is modified to provide a recess into which the wiring and the face plate 225 may be fitted. Thus, the face plate 225 is preferably flush with the edge of the door. The extended faceplate 225 in this case is the control line shield 180.

Thus, the control line shield 180 helps to keep the control line that runs from the access reader control 105 to the electric lock 190 safe from outside interference and tampering. The control line shield 180 seals the control line into the interior of the door to prevent easy access. Additionally, the control line shield 180 may be removed as necessary to provide service to the wireless access control system 100.

In addition to the single, larger face plate 225 shown in FIG. 1, the control line shield 180 may take the form of two separate face plates, a first face plate that is standard for the lock 190 and an additional extension face plate. The extension face plate then extends from the top of the standard face plate to cover the additional vertical run of the wiring.

Figure 3:
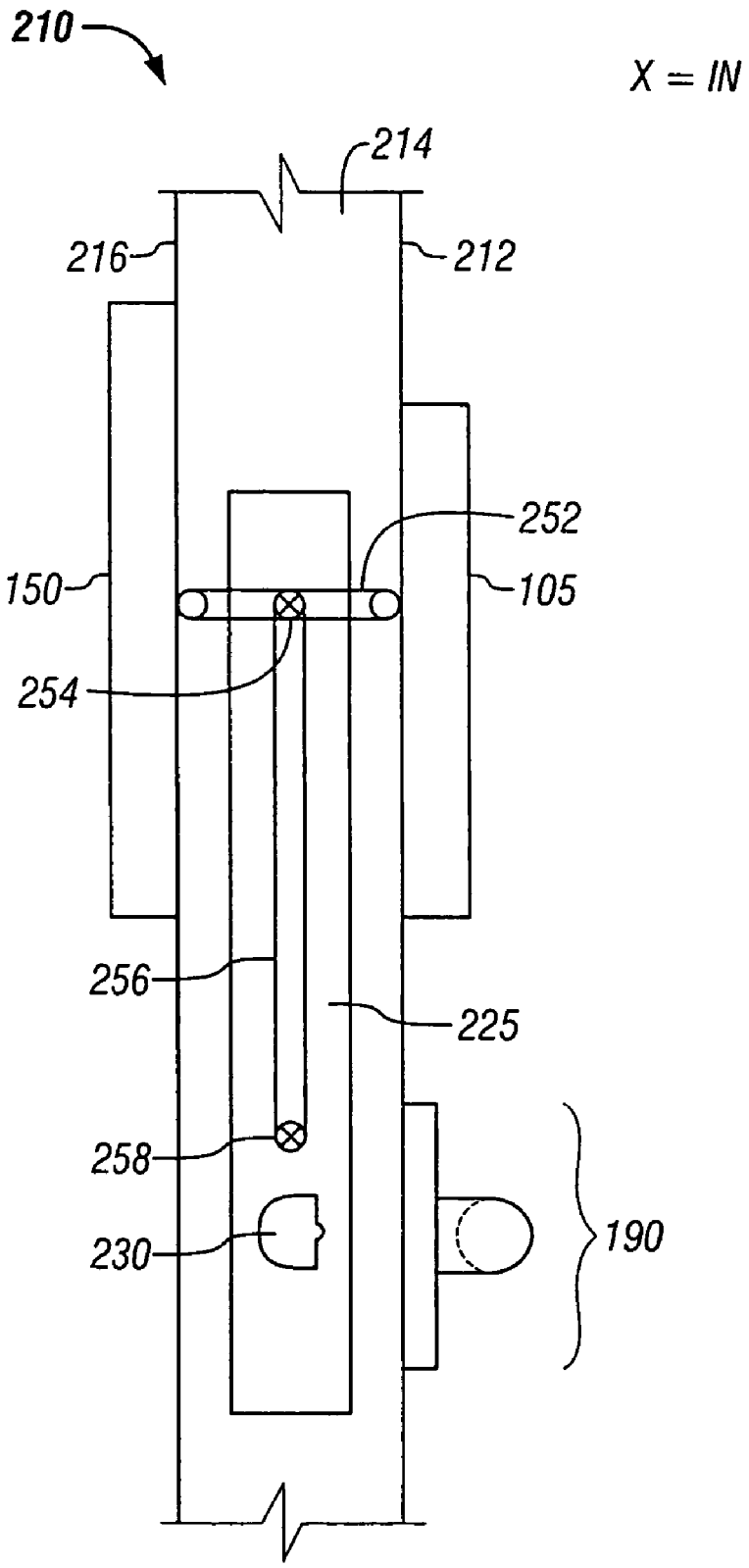
FIG. 3 illustrates a side view of the installation of the wireless access control system according to a preferred embodiment of the present invention.

FIG. 3 illustrates a side view of the installation of the access control system according to a preferred embodiment of the present invention. As shown in FIG. 3, the access reader control 105 and the access control electronics 150 may be wired together through the through-door channel 252. Wiring may then be drawn from either the access reader control 105 or the access control electronics 150 through the through-door channel 252 and then through the out-to-edge channel 254 to the door edge 214. The wiring may then pass along the door edge 214 in the along-edge channel 256 to the in-to-lock channel 258 to the electric lock 190.

Figure 4:
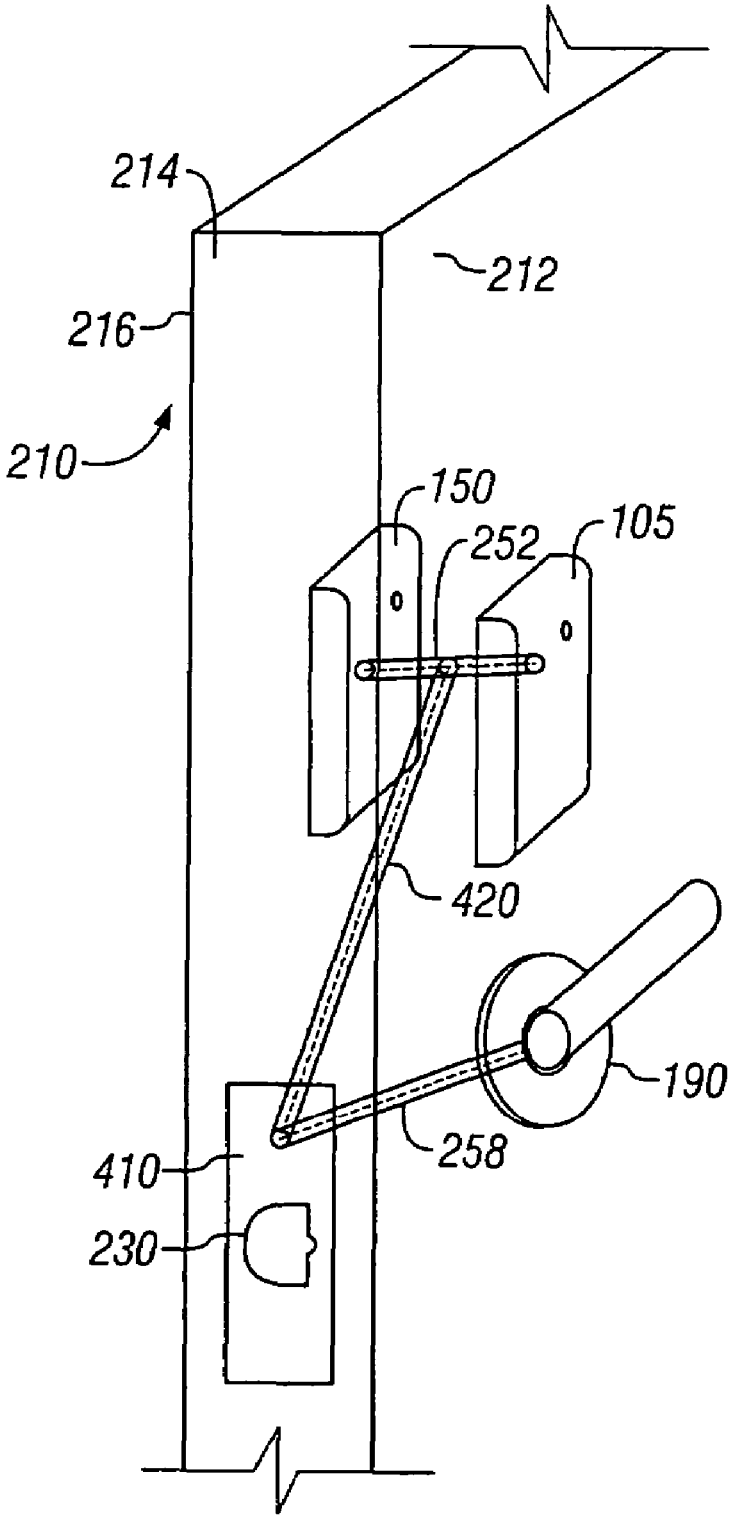
FIG. 4 illustrates a perspective view of an alternative embodiment of the installation of a wireless access control system.

FIG. 4 illustrates a perspective view of an alternative embodiment of the installation of the access control system. FIG. 4 includes the access reader control 105, access control electronics 150 and electric lock 190 with latch 230 installed in the door 210 which includes the door front face 212, the door edge 214 and the door back face 216. FIG. 4 also includes the through-door channel 252 and in-to-lock channel 258.

However, instead of the extended face plate 225 of FIGS. 2 and 3, FIG. 4 includes a standard faceplate 410. Additionally, instead of the out-to-edge channel 254 and the along-edge channel 256 of FIGS. 2-3, FIG. 4 includes a single slope-to-edge channel 420.

In operation, system FIG. 4 performs similarly to the system FIGS. 2-3, except that the single slope-to-edge channel 420 eliminates the need for the out-to-edge channel 254 and the along-edge channel 256. Additionally, the slope-to-edge channel 420 preferably emerges at the door edge 214 behind the faceplate 410. However, the faceplate 410 is typically a standard faceplate such as may have been previously installed in the door 210. Thus, the extended faceplate 225 is not necessary to prevent access to the control line and the standard faceplate performs as the control line shield 180.

However, the embodiment of FIG. 4 may be less preferable because the slope-to-edge channel 420 may be difficult to form or may compromise the integrity of the door or may be difficult to service. Conversely, the embodiment of FIG. 4 may be more preferable in instances when less modification to the door edge 214 is desired.

Alternatively, a the channel may be a hole or passage formed from the access reader control 105 or access control electronics 150 downward directly to the electric lock 190 through the door 210. However, such a hole or passage may be exceedingly difficult to form and may significantly compromise the integrity of the door, as well as being difficult to service.

While particular elements, embodiments and applications of the present invention have been shown and described, it is understood that the invention is not limited thereto since modifications may be made by those skilled in the art, particularly in light of the foregoing teaching. It is therefore contemplated by the appended claims to cover such modifications and incorporate those features which come within the spirit and scope of the invention.

The invention claimed is:

1. A security system for providing security between a locking system at an access point having first and second exterior surfaces and a door face that extends between a first substantially linear edge of the first exterior surface and a second substantially linear edge of the second exterior surface and defines a third exterior surface, wireless access control electronics mounted exteriorly on the first exterior surface configured to communicate with systems external to the access point, and an access reader control mounted exteriorly on the second exterior surface, said security system including:

a reader line connecting the wireless access control electronics to the access reader control;

a passage positioned interiorly between the first and second exterior surfaces of the access point, and shielding at least a portion of the reader line;

a channel formed in the door face and defining an opening at the door face and a bottom surface;

a control line shield separate from and attached to the door face and covering the opening, the control line shield and the channel cooperating to define a control line space;

a control line coupling and extending between the locking system and the wireless access control electronics, and at least a portion of the control line being positioned within the control line space where the portion of the control line in the control line space is outside of the bottom surface and is positioned between the bottom surface and the control line shield, said control line relaying control signals from the wireless access control electronics to said locking system; and an electric lock in said locking system, said electric lock able to perform both a locking operation and an unlocking operation, wherein said electric lock performs one of a locking operation and an unlocking operation in response to said control signals, wherein said access reader control reads access information using a proximity reader to determine said control signals to be transmitted to said electric lock; and wherein the wireless access control electronics generate the control signals based on access signals wirelessly received from a system external to the access point.

2. The system of claim 1 wherein the access point includes a door, and wherein the control line shield includes a plate attached to the door face.

3. The system of claim 2 wherein said security system is installed with said access reader control mounted at one side of said door and said access control electronics mounted at a different side of said door.

4. The system of claim 3 wherein said control line runs from said access control electronics to said door face.

5. The system of claim 4 wherein said control line runs along said door face to said locking system.

6. The system of claim 4 wherein said control line is entirely shielded by said control line shield at said door face.

7. The system of claim 2, wherein the control line shield is a face plate mounted in said door face of said door.

8. The system of claim 2 wherein said reader control line and the enclosed passage runs through said door allowing said door to operate as a reader control line shield.

9. The system of claim 7, wherein said face plate operates in conjunction with a preexisting face plate and latch to prevent physical access to said control line.

10. A method for providing security between a locking system at an access point having first and second exterior surfaces and a door face that extends between a first substantially linear edge of the first exterior surface and a second substantially linear edge of the second exterior surface and defines a third exterior surface, access control electronics mounted exteriorly on the first exterior surface configured to communicate with systems external to the access point, and an access reader control mounted exteriorly on the second exterior surface, said method including:

connecting a reader line to the access control electronics and the access reader control;

shielding at least a portion of the reader line interiorly between the first and second exterior surfaces of the access point;

extending a control line between a locking system and the access control electronics, at least a portion of the control line disposed in an open channel formed in the door face such that the portion of the control line is outside of the access point;

reading access information at said access reader control using a biometric reader;

wirelessly receiving access instructions from a system external to the access point at the access control electronics;

determining control signals from the access instructions;

relaying said control signals from the reader line to said locking system using said control line;

performing one of a locking operation and an unlocking operation at an electric lock in said locking system in response to said control signals wherein said electric lock is able to perform both a locking operation and an unlocking operation; and positioning a control line shield over the channel to enclose the portion of the control line positioned outside of the access point.

11. The method of claim 10 wherein the access point includes a door, and wherein the control line shield includes a plate attached to the door face.

12. The method of claim 10 wherein shielding at least a portion of the control line further comprises shielding at least a portion of the control line in the access point with a control line shield extending from the passage to the locking system.

13. The method of claim 12 wherein the control line shield includes a face plate in the edge of said door.

14. The method of claim 13 wherein said face plate operates in conjunction with a preexisting face plate to prevent physical access to said control line.

15. A system for securing a door having a first surface defining a first substantially linear edge, a second surface defining a second substantially linear edge, and a third surface extending between the first edge and the second edge, the system comprising:

an access reader configured to be mounted exteriorly on the first surface of the door, to read access information, and to generate reader signals;

a first link coupled to the access reader, positioned interiorly between the first and second surfaces, and configured to relay the reader signals;

a channel formed in the third surface and having an open portion between the first and second surfaces of the door, and configured to house at least a portion of the first link such that the portion of the first link is outside of the door;

control electronics coupled to the first link and mounted exteriorly on the second surface of the door to receive the reader signals, and operable to wirelessly transmit and receive wireless signals to and from a system external to the door based on the reader signals, and to generate access signals based on the wireless signals;

a second link coupled interiorly between the first and second surfaces of the door to the control electronics, at least a portion of the second link being housed in the channel, and configured to relay the control signals;

a control line shield separate from the door, the control line shield connected to the third surface to enclose the open portion of the channel and cover the portion of the first link that is outside of the door; and an electric lock configured to be mounted to the door, coupled to the second link, and configured to receive the access signals, and to lock and unlock the door based on the access signals.

16. The system of claim 15, wherein the access reader comprises at least one of a biometric reader, a magnetic stripe card reader, and a proximity reader.

17. The system of claim 15, wherein the control electronics is configured to be mounted on another side of the door.

18. The system of claim 15, wherein the channel comprises a first passage configured to house at least a portion of the first and second links therein, and a second passage integrally connected to the first channel and configured to house at least another portion of the second link therein.

19. A system for securing a door having a first surface, a second surface, and a door face disposed between the first surface and the second surface, the door face defining an exterior surface of the door, the system comprising:

an access reader mounted on the first surface of the door to read access information and to generate reader signals;

a first link coupled to the access reader and positioned substantially interiorly between the first surface and the second surface and configured to relay the reader signals;

control electronics coupled to the first link and mounted on the second surface of the door to receive the reader signals and to wirelessly transmit and receive wireless signals to and from a system external to the door based on the reader signals, and to generate access signals based on the wireless signals;

an electric lock mounted to the door to receive the access signals and to lock and unlock the door based on the access signals;

a second link positioned to electrically connect the control electronics and the electric lock, at least a portion of the second link extending along the door face external of the door; and a control line shield separate from the door, the control line shield connected to the door face to enclose the portion of the second link that is external of the door.

* * * * *